United States Patent [19]

Anderson

[11] Patent Number: 4,523,125

[45] Date of Patent: Jun. 11, 1985

[54] FLUORESCENT LAMP ELECTRODES

[75] Inventor: John M. Anderson, Scotia, N.Y.

[73] Assignee: General Electric Company, Schenectady, N.Y.

[21] Appl. No.: 567,464

[22] Filed: Jan. 3, 1984

Related U.S. Application Data

[63] Continuation of Ser. No. 282,883, Jul. 13, 1981, abandoned, which is a continuation of Ser. No. 972,497, Feb. 9, 1979, abandoned.

[51] Int. Cl.[3] ..... H01J 61/067

[52] U.S. Cl. ..... 313/491; 313/618; 313/339

[58] Field of Search ..... 313/212, 344, 491, 217, 313/485, 339, 345, 346 R, 492, 618, 629

[56] References Cited

U.S. PATENT DOCUMENTS

| | | | |
|---|---|---|---|
| 1,797,990 | 3/1931 | Lucian | 313/344 X |
| 2,114,536 | 4/1938 | Kirsten | 313/212 X |
| 2,208,467 | 7/1940 | Lowry | 313/345 |
| 2,258,158 | 10/1941 | Lowry | 313/344 |
| 2,657,325 | 10/1953 | Homer et al. | 313/345 |
| 2,937,302 | 5/1960 | Goldberg | 313/212 |
| 3,215,882 | 11/1965 | Toomey | 313/492 |
| 3,341,917 | 9/1967 | Oyabu et al. | 313/344 |
| 3,883,764 | 5/1975 | Johnson et al. | 313/217 X |
| 3,919,579 | 11/1975 | Lemmers | 313/492 |
| 4,117,374 | 9/1978 | Witting | 313/217 X |

*Primary Examiner*—David A. Moore
*Assistant Examiner*—K. Wieder
*Attorney, Agent, or Firm*—Mark L. Mollon; James C. Davis, Jr.; Marvin Snyder

[57] ABSTRACT

A novel electrode structure for a fluorescent lamp, particularly one employing a low discharge gas pressure, comprises a directly heated hollow cathode interiorly coated with an emissive mixture. In accordance with one embodiment of the present invention, a flat metal ribbon is wound to form a helix which is heated resistively. In accordance with another embodiment of the present invention, a flat metal ribbon is wound in a flat spiral configuration and likewise heated resistively. In yet another embodiment of the present invention, a fluorescent lamp electrode comprises a metal cylinder heated directly by a filamentary coil disposed about the circumference of the cylinder and electrically insulated therefrom.

2 Claims, 12 Drawing Figures

Fig. 3
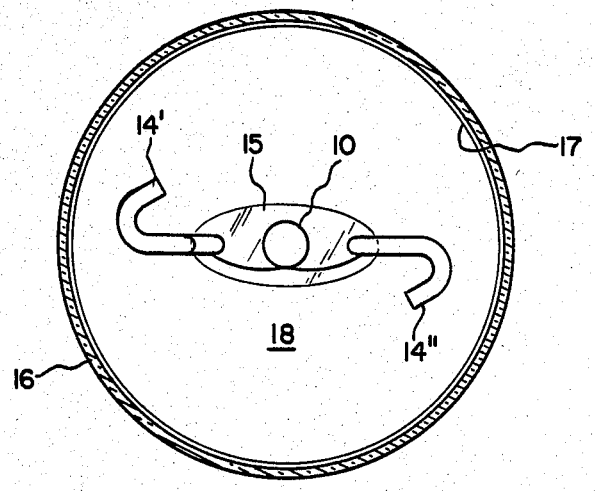
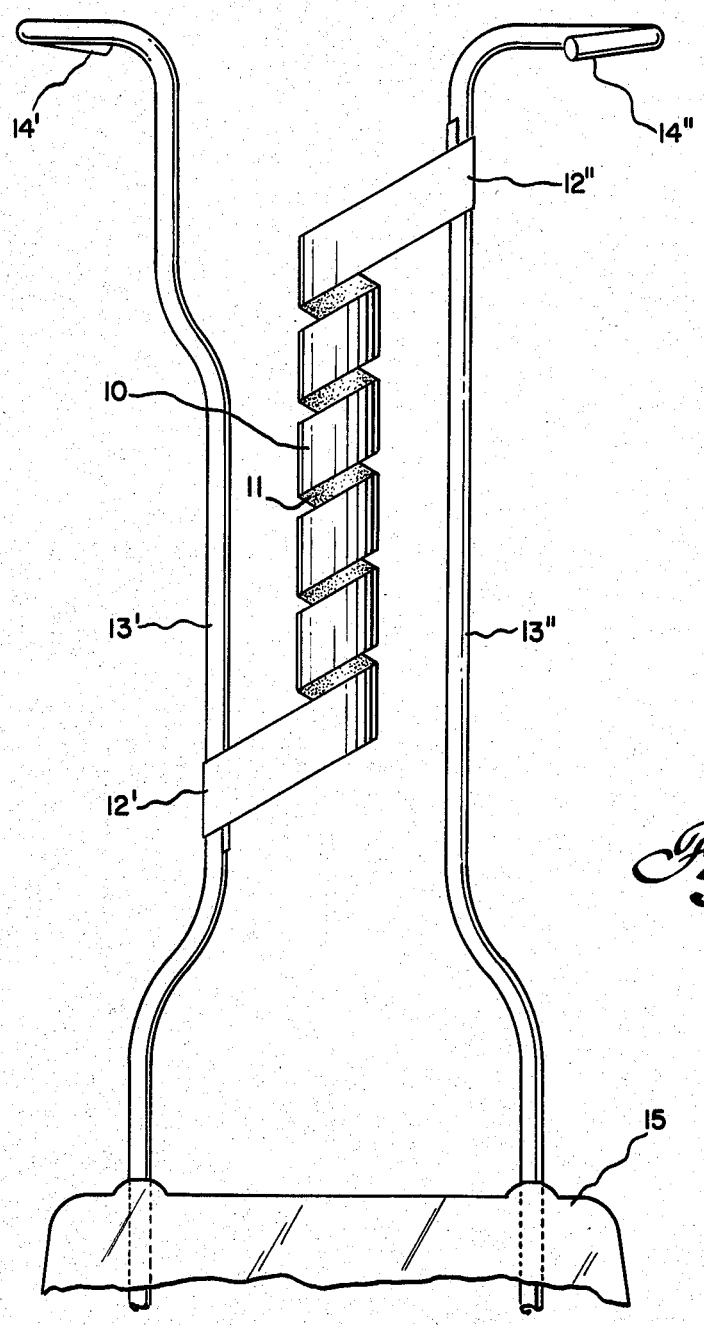
Fig. 2

Fig. 5
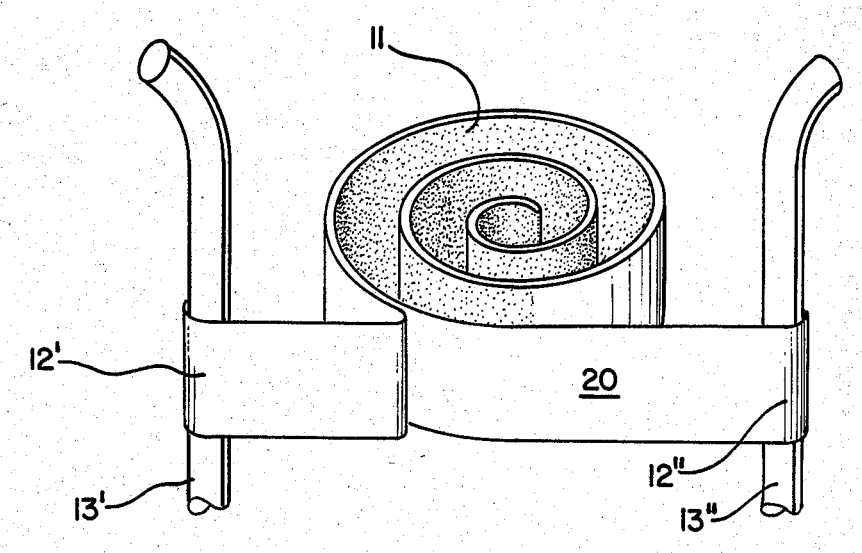
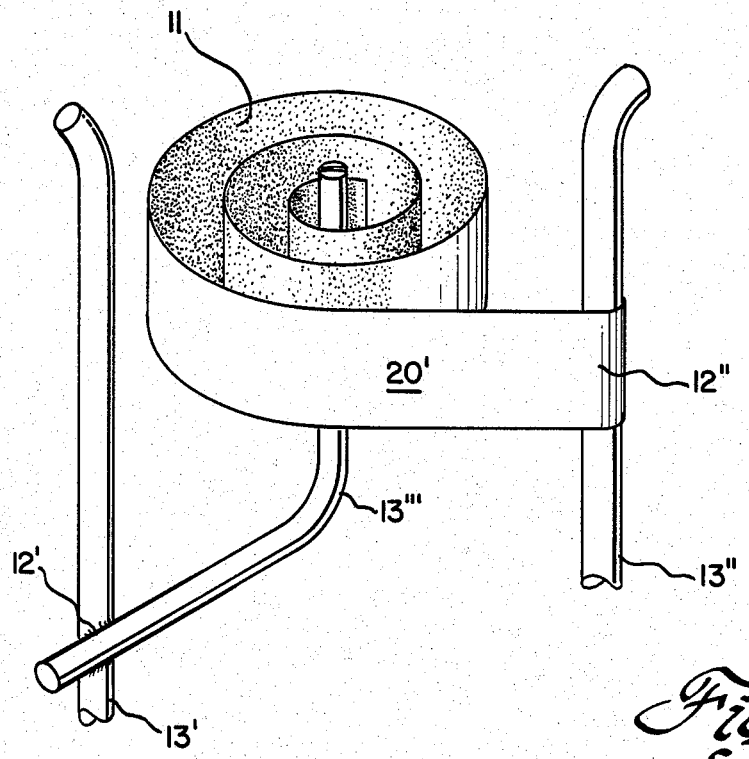
Fig. 6

FLUORESCENT LAMP ELECTRODES

This application is a continuation of application Ser. No. 282,883, filed July 13, 1981, which is a continuation of RD-9752, Ser. No. 972,497, filed Feb. 9, 1979, now abandoned.

BACKGROUND OF THE INVENTION

This invention relates to electrode structures for fluorescent lamps and in particular to an electrode structure comprising a directly heated hollow cathode for use in low pressure fluorescent lamps.

While present fluorescent lamps, typically operating at an efficacy of approximately 70 lumens per watt, are significantly more efficient than incandescent lamps, operating at an efficacy of approximately 15 lumens per watt, nonetheless the efficacy of fluorescent lamps may be improved even further. In particular, it is known that an operating discharge gas pressure within the lamp of approximately 1 torr is most efficacious in terms of the energy efficiency of the lamp. However, present fluorescent lamps operate at a gas discharge pressure approximately 2.5 torr. Moreover, the typical present fluorescent lamp employs a filamentary coil-on-coil cathode structure coated with a conventional emission mix. At the desired low gas pressure, most prior art cathode structures sputter excessively, particularly during lamp starting. This sputtering deposits material on the fluorescent lamp envelope so as to reduce the light output from the lamp and accordingly, shorten its useful life.

Uther known electrode structures include hollow metal cylinders comprising a thin refractory metal material with electron emissive material coating the interior surface of the cylinder. These cylindrical electrodes possess the advantage that diffuse thermionic electron emission occurs during operation of the electrode in a hollow cathode mode which is typically achieved by heating the cylinder to a temperature of approximately 800° C. However, during starting and before this temperature is reached, heavy sputtering in the arc mode of discharge occurs. Thus, electrode structures comprising only a hollow cathode do not survive many lamp starting cycles.

Two U.S. Patents describe certain electrode structures which are relatively insensitive to the problem of sputtering and which are usable in fluorescent lamps having relatively low (that is approximately 1 torr) discharge gas pressure. In the first patent (U.S. Pat. No. 3,883,764 issued May 3, 1975 to Peter D. Johnson and the applicant herein and assigned to the same assignee as the present invention) there is disclosed a cylindrical electrode structure with a filamentary coil disposed within the cylinder. No direct heating of the cylinder occurs however, and the filamentary coil is not in contact with the cylinder. Thus, the hollow cathode portion of the electrode, namely, the cylinder, is heated only indirectly. Additionally, no ohmic or resistive heating of the hollow cathode cylinder itself occurs. In a second U.S. Pat. (No. 4,117,374 issued Sept. 26, 1978 to Harald L. Witting and likewise assigned to the same assignee as the present invention),there is disclosed an electrode structure similar to that discussed immediately above except that the cylindrical structure is tapered so as to speed the transition from an arc discharge mode to a diffuse hollow cathode operating mode. However, heating of the hollow cathode structure itself is only indirectly accomplished and no means for providing direct resistive heating to a hollow cathode structure is disclosed in either of the two aforementioned patents, both of which are incorporated herein by reference as background material.

SUMMARY OF THE INVENTION

In accordance with a preferred embodiment of the present invention, an electrode structure for a low pressure fluorescent lamp comprises a hollow cathode coated interiorly with an emissive mixture and heated directly to facilitate easy starting with a minimum of sputtering. In accordance with the preferred embodiment of the present invention, the direct heating of a hollow cathode structure occurs through resistive heating of the hollow cathode itself which comprises a flat metal ribbon wound in the form of a helix. The interior portion of the helix has deposited thereon electron emissive material. In accordance with another embodiment of the present invention, a flat metal ribbon is wound into a spiral structure, also possessing an interior electron emissive coating and being heated resistively. Still another embodiment of the present invention, comprises a thin metal cylinder with electron emissive material on the interior surface thereof and with a filamentary coil disposed about the exterior of the cylinder, but electrically insulated therefrom, so as to directly heat the hollow cathode cylinder.

Accordingly, it is an object of this invention to provide an electrode structure comprising a directly heated hollow cathode, particularly for use in low pressure fluorescent lamps. Also, it is an object of the present invention to provide long life fluorescent lamps exhibiting high efficacy and optimal light output. Still, another object of the present invention is to provide a fluorescent lamp in which the transition from an arc discharge mode to a diffuse thermionic hollow cathode mode occurs with minimal sputtering in spite of the low gas pressure required for high efficacy.

DESCRIPTION OF THE DRAWINGS

FIG. 2 is a perspective view illustrating the attachment of the embodiment of FIG. 1 to fluorescent lamp structures.

FIG. 3 is a top view of the structure in FIG. 2 mounted in a tubular fluorescent lamp envelope.

FIG. 5 is a perspective view illustrating an embodiment of the present invention in which the hollow cathode comprises a spirally wound, flat metal ribbon heated resistively.

FIG. 6 is a perspective view illustrating an alternate embodiment of the spiral cathode shown in FIG. 5.

DETAILED DESCRIPTION OF THE INVENTION

Figure 1:
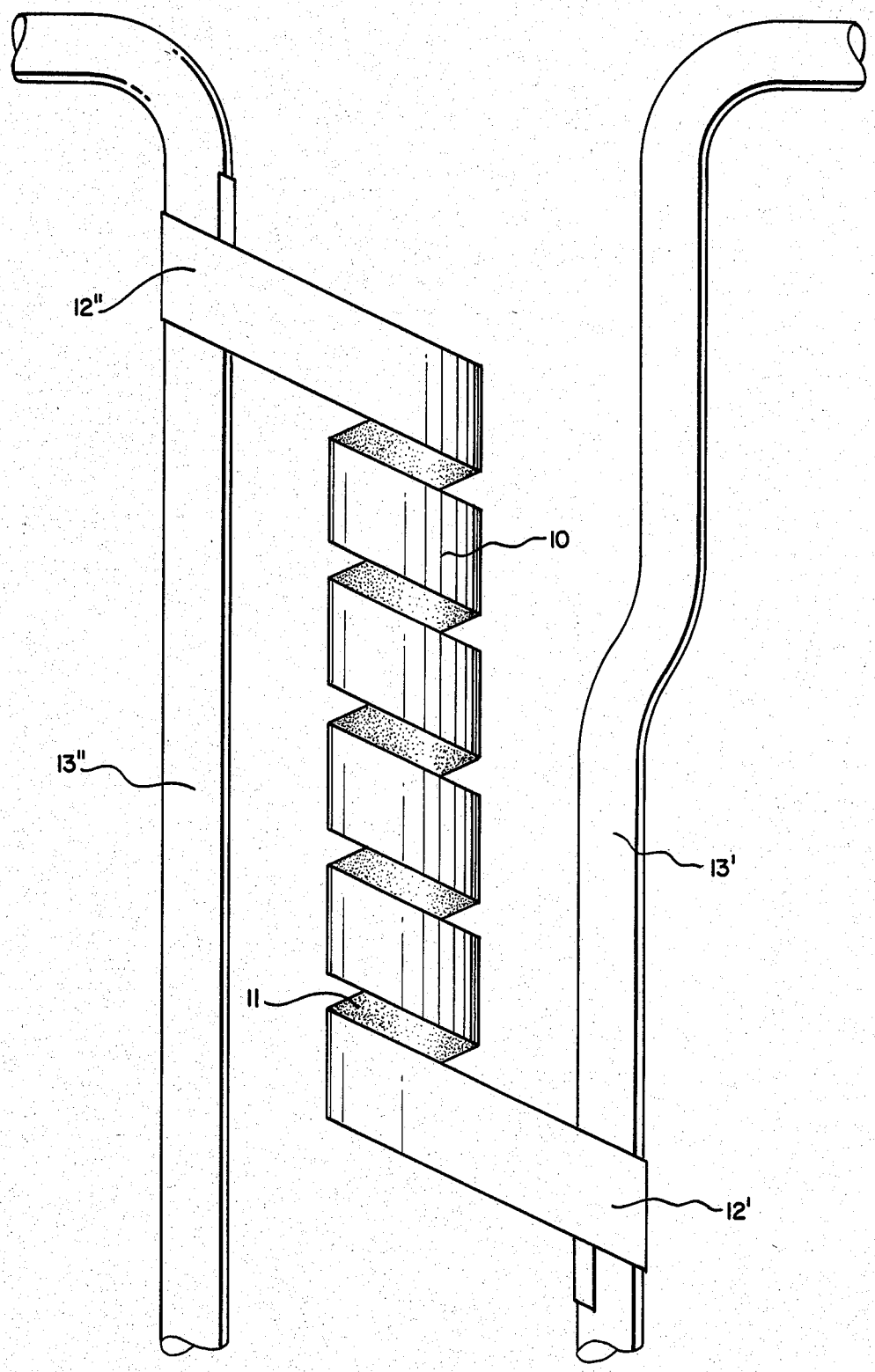
FIG. 1 is a perspective view illustrating an embodiment of the present invention comprising a helical hollow cathode structure heated ohmically.

In the embodiment of the present invention illustrated in FIG. 1, a thin flat metal ribbon is wound into the form of helix 10 acting as a hollow cathode. The metal may comprise any convenient refractory metal such as molybdenum, tungsten, or rhenium, or a metal such as nickel. The interior of the helical cathode is coated with an electron emissive mix, for example, one or more of the alkaline earth oxides or one or more of the rare earth oxides or one or more of the oxides of thorium, yttrium, zirconium, hafnium,or tantalum. The material of the helical metal cathode 10 is not critical but should comprise an electrically conductive material exhibiting a high melting Point. The metal ribbon from which the helical cathode 10 is formed should also be relatively thin compared to the diameters of the support leads 13' and 13" to which the helical cathode 10 is spot welded at points 12' and 12", respectively. This latter requirement assures that electrical current passed through the cathode 10 through electrical support means 13' and 13" causes heating of the cathode 10. Accordingly, the metal ribbon from which the hollow cathode 10 is formed is typically between approximately 0.005 millimeters and approximately 0.05 millimeters in thickness. Additionally, in a typical fluorescent lamp of the present invention, the helical cathode structure is approximately 3 millimeters in diameter and approximately 15 millimeters long. An initial preheating current of approximately 5 amperes is sufficient to cause preheating of the cathode 10 to a temperature of approximately 800° C. at which diffuse thermionic emission begins.

Since most electron emissive mixtures must be activated prior to use, the resistive heating of the electrode structure shown in FIG. 1 may be very effectively employed to bring about a highly controlled activation following lamp assembly. Typically, however, such activation employs higher than normal temperatures and to avoid sputtering of the emissive mixture, the mixture is confined to an internal region of the helix only and should not be present on the metal ribbon in the regions of the spot welds 12' and 12". Thus, the cathode 10 of the present invention is heated once during normal lamp life to activate the electron emissive mixture and thereafter, the cathode 10 is preheated by currents of approximately 5 amperes during the normal lamp starting mode. Lower starting currents may be sufficient, however, depending upon the material and exact dimensions of the cathode structure. But nonetheless, these currents will typically be higher than the conventional 1 ampere preheating current presently employed in standard fluorescent lamps.

While it is possible to operate fluorescent lamps from direct current power sources, the wide spread use of alternating current sources implies that the most practical fluorescent lamps should be designed with this condition in mind. In fact, almost all fluorescent lamps are powered from alternating current sources and operate in a manner in which the arc discharge current flows in alternating directions between electrodes disposed at opposite ends of a tubular light-transmissive evacuable envelope. Thus, during alternating half cycles, the electrodes operate alternately as a cathode and then as an anode. Accordingly, FIG. 2 illustrates an embodiment of the present invention in which the hollow cathode structure of FIG. 1 is mounted on electrically conductive support leads 13' and 13" which terminate in structures 14' and 14", respectively, known as anode flags. These anode flags serve to conduct some of the discharge current during that portion of the cycle when the electrode operates as an anode. Whether or not anode flags are used depends upon the design of a particular fluorescent lamp, those using higher discharge current generally requiring flags. Preferably, the anode flags exhibit the same current carrying capabilities as the support leads themselves. As shown further in FIG. 2, support leads 13' and 13" are disposed through glass stem press 15. Thus, support leads 13' and 13" serve not only to support the hollow cathode structure 10 but also serve as electrical feed-throughs for electrical connections.

FIG. 3 is a top view of the structure of FIG. 2 further illustrating the disposition of the electrode structure in one end of a conventional fluorescent lamp. Here electrode structure 10 mounted on stem press 15 and further including anode flags 14' and 14" is disposed within a tubular light-transmissive evacuable glass envelope 16 which includes a phosphor coat 17 disposed on the interior wall of the envelope. Gaseous discharge medium 18 is also contained within the envelope and typically comprises a mixture of mercury vapor and a rare gas such as krypton, argon, or neon. The electrodes of the present invention are particularly efficacious when the gas discharge pressure is approximately 1 torr. While most of the gas discharge pressure arises from the rare gas, mercury vapor is present at a partial pressure of approximately 8 microns (i.e., 8 millitorr).

Figure 4:
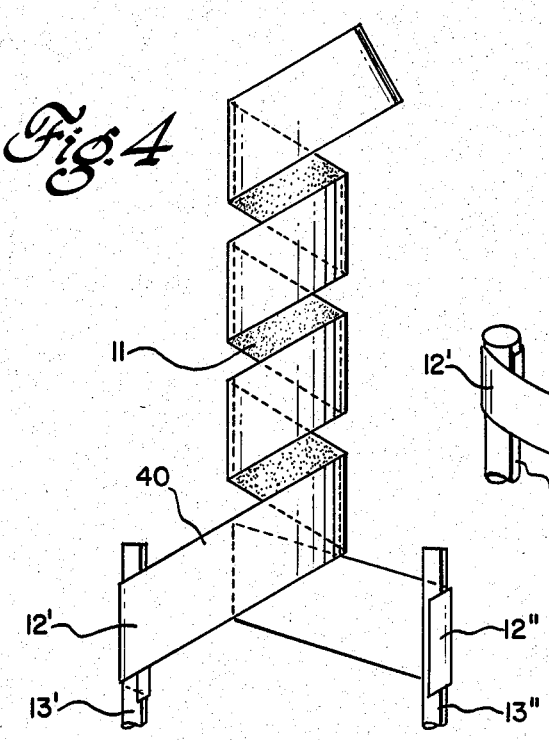
FIG. 4 is a perspective view illustrating an embodiment of the present invention comprising a helical hollow cathode structure formed from a folded metal ribbon.

In addition to the helical structure illustrated in FIG. 1, an alternate helical structure is illustrated in FIG. 4. This embodiment comprises a helix-within-a-helix structure 40 formed by winding a folded metal ribbon about a cylinder. In this embodiment, the helical structures are essentially parallel with one portion of the folded metal ribbon forming an exterior surface and another portion of the folded metal ribbon forming an interior surface as shown in FIG. 4. The emissive mixture 11 is preferably deposited on the interior surface of the structure, that is, on the surface nearest the axis of the helix. The material for the metal ribbon comprises those materials as indicated above. The resulting hollow cathode structure is then conventionally mounted to support leads 13' and 13" by spot welding at points 12' and 12", respectively.

FIG. 5 illustrates another embodiment of the electrode of the present invention in which the hollow cathode structure is resistively heated. The electrode materials are nonetheless the same as those used in the embodiment shown in FIG. 1. Thin metal ribbon is first folded approximately in half and formed into a flat spiral structure 20 as shown in FIG. 5. Electron emissive mix 11 coats the interior surfaces of the spiral as shown. The folding of the metal ribbon permits easy attachment of the spiral structure to support leads 13' and 13" by means of spot welding at points 12' and 12" as indicated. Thus, the spiral-within-a-spiral structure forms a continuous electrical current path between the support leads. Care is to be taken in forming the spiral structure to insure that short circuiting between adjacent layers does not occur. One advantage of the spiral structure of FIG. 5 over the helical structure of FIG. 1 is that the spiral structure is better able to reflect heat inward towards its center and is therefore better able to maintain stable thermionic emission conditions.

FIG. 6 illustrates an alternate embodiment of the spiral structure shown in FIG. 5. In FIG. 6 the spiral structure 20' comprises a single layer of metal ribbon as shown. This embodiment is formed less critically with respect to the development of short circuiting paths between layers as compared with the embodiment shown in FIG. 4. Nonetheless, the spiral structure 20' requires lead 13''' acting to support the spiral cathode and to electrically connect it to support lead 13'.

Figure 7:
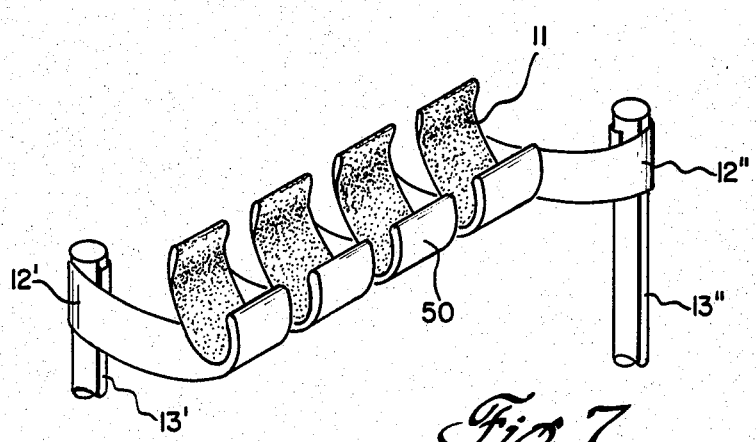
FIG. 7 is a perspective view illustrating an embodiment of the present invention comprising an indented helical structure.
Figure 8A:
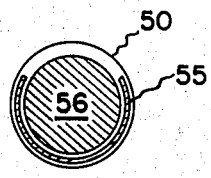
FIGS. 8*a*–8*c* illustrate a method of manufacturing the electrode structure shown in FIG. 7.
Figure 8B:
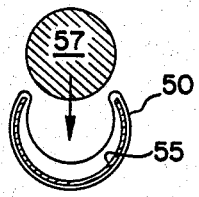
Figure 8C:
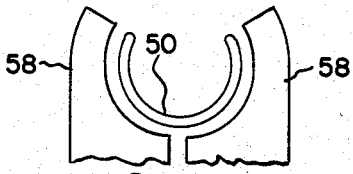

FIG. 7 illustrates another embodiment of the present invention in which the hollow cathode structure is formed by indenting one side of a helically wound ribbon. The resulting electrode structure 50 is then coated with an emissive mix 11 and conventionally attached to support leads 13' and 13'' as above. The structure of FIG. 7 may be easily formed as illustrated by the sequence of illustrations in FIGS. 8*a*–8*c*. In particular, FIG. 8*a* illustrates the helical ribbon 50 wound about a solid cylindrical mandrel 56 and also about a thin walled partial cylinder 55 which is removable. FIG. 8*b* illustrates the next step in the process following the removal of the mandrel 56 in FIG. 8*a*, after which smaller shaping mandrel 57 presses the helical metal ribbon 50 into the shape shown against the thin walled partial cylinder 55. Partial cylinder 55 is then removed as is shaping mandrel 57 and the metal ribbon structure 50 is pressed into its final shape between forming jaws 58 as illustrated in FIG. 8*c*.

Figure 9:
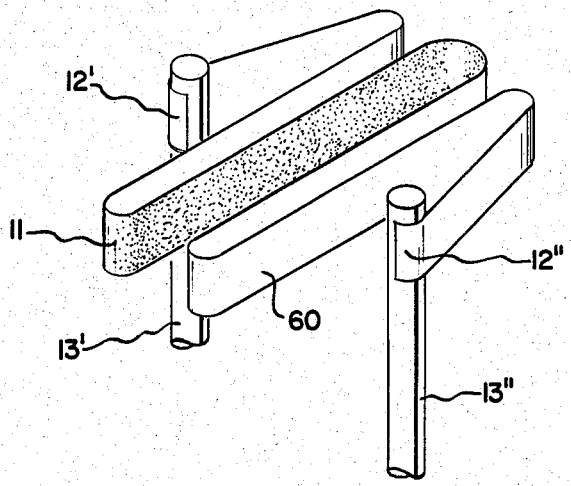
FIG. 9 is a perspective view illustrating an embodiment of the present invention comprising a metal ribbon folded in a zig-zag pattern.

FIG. 9 illustrates still another embodiment of the present invention in which a diffuse hollow cathode discharge mode is effected by a metal ribbon folded in a zig-zag pattern with the ends of the ribbon attached to supporting electrodes 13' and 13'' by spot welding at points 12' and 12'', respectively, as shown. In this embodiment, hollow cathode structure 60 is coated on the interior surfaces with a conventional electron emissive mixture 11, such as those indicated above. The exterior surfaces, particularly those nearest the supporting electrodes 13' and 13'' are left uncoated. Additionally, these exterior surfaces act as a radiation shield, reflecting thermal radiation back towards the central portion of the hollow cathode structure. As indicated above, the use of such a thermal radiation reflective shield enhances the thermionic emission stability of the electrode.

Figure 10:
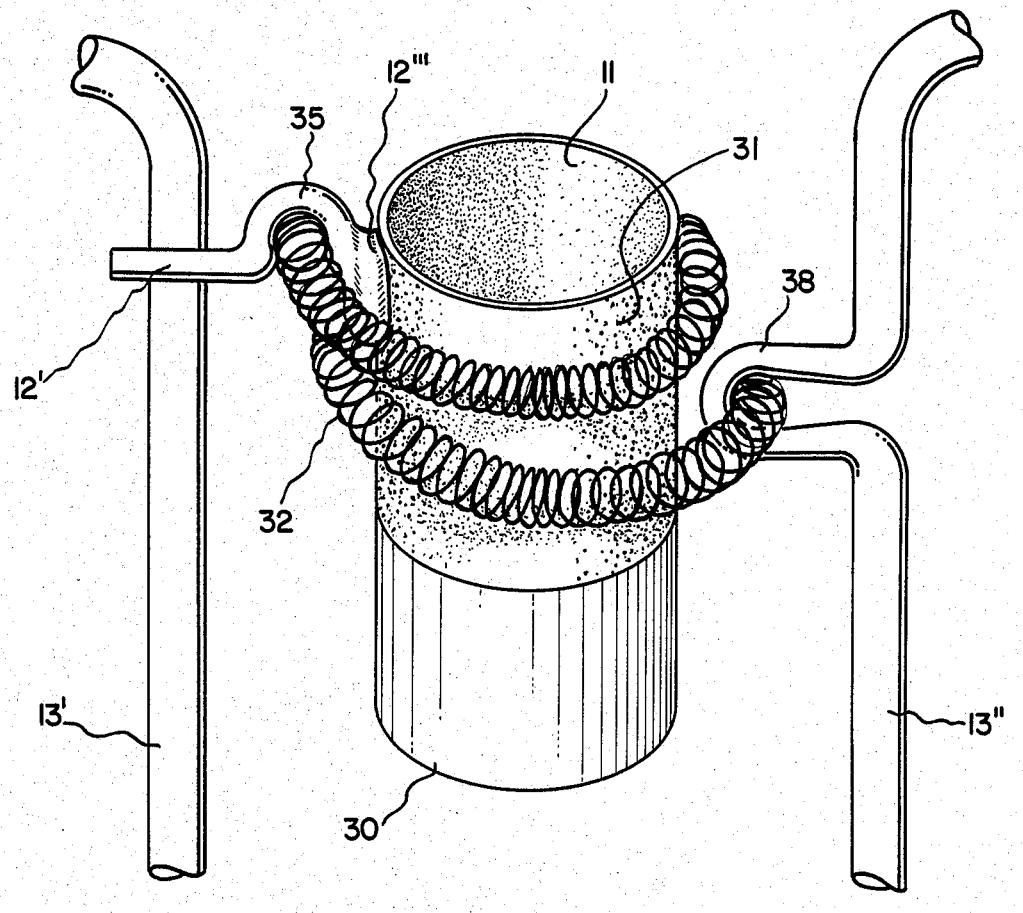
FIG. 10 is a perspective view illustrating still another embodiment of the invention comprising a thin metal cylinder heated directly by a coil disposed about the circumference of the cylinder and electrically insulated therefrom.

FIG. 10 illustrates yet another embodiment of the present invention in which a hollow cathode electrode structure is heated directly by means of a filamentary coil surrounding a thin metal cylinder rather than by the passage of an electrical current through the cylinder itself. Nonetheless, diffuse, thermionic emission in a hollow cathode discharge mode results. As above, the emissive mixture composition and the composition of the thin metal cylinder 30 may be the same as that described for the emissive mixture and metal ribbon of the embodiments of FIGS. 1 and 5, for example. Thin metal cylinder 30, coated interiorly with an emissive mixture 11 is supported by means of lead 35 which is spot welded to support lead 13' at location 12' and which is further spot welded to the cylinder at spot 12'''. Coil 32 serving to directly heat cylinder 30 may be conveniently attached electrically between squeezed portions of supporting lead 35 as shown. The coil 32 is also preferably coated with an electron emissive mixture along those portions for which the coil is in contact with the cylinder 30. The coil, itself, preferably comprises a coil-in-coil structure, that is, a helix wound into a second larger helical structure. Such coil-in-coil structures are common in conventional fluorescent lamps. For purposes of sputter avoidance particularly during emissive mix activation, however, it is definitely preferable that the emissive mix does not coat the coil 32 near its connections to supports leads 13' and 13''. While one end of coil 32 is electrically attached to supporting member 35, the other end of the coil may be conveniently attached to support lead 13 by squeezed portion 38, as shown. Additionally, the metal cylinder 30 must be electrically insulated from coil 32 to insure that short circuiting of the current path does not occur. Thus, in the electrode structure of FIG. 10, a thin alumina layer 31 disposed between the exterior surface of the cylinder 30 and the coil 32 is preferred. Additonally, the activation of the emissive mix 11 on the interior of the cylinder 30 is not as easily achieved in the structure shown in FIG. 10 as compared to the hollow cathode structure shown in FIG. 1, for example. In particular, sufficiently high activation temperatures may not be as easily reachable using the resistive heating of the coil 32 alone. Nonetheless, heating from the coil 32 and radio frequency inductive heating of the metal cylinder are sufficient to achieve this activation. Electrode preheating prior to to lamp starting during normal operation is accomplished by passing sufficient current through coil 32.

From the above, it may be appreciated that the present invention provides an electrode for use in low pressure fluorescent lamps so as to enable them to operate at greater efficacy with a minimum sputtering problem. The lamps of the present invention exhibit long life and reduced electrode drop. This is particularly true if the lamp operating frequency is above approximately 1 kilohertz.

While this invention has been described with reference to particular embodiments and examples, other modifications and variations will occur to those skilled in the art in view of the above teachings. Accordingly, it should be understood that within the scope of the appended claims, the invention may be practiced otherwise than is specifically described.

The invention claimed is:

1. A fluorescent lamp employing a low discharge gas pressure, said lamp comprising:
   - an evacuable, light-transmissive envelope having opposed ends and coated interiorly with phosphor;
   - a gaseous discharge medium disposed within said envelope; and
   - electrode means disposed at opposed ends of said envelope, said electrode means including at least one directly heated hollow cathode, coated interiorly with an emissive mixture and disposed between at least two spaced electrode supply wires for supplying electrical energy to heat said cathode, said hollow cathode comprising a metal cylinder with a filamentary coil for heating said cylinder, said coil being connected to said supply wires and disposed about the circumference of said cylinder, said coil being electrically insulated from said cylinder.

2. The lamp of claim 1 in which said cylinder is insulated from said coil by an alumina layer disposed between said coil and said cylinder.

* * * * *